United States Patent [19]

Heinemann

[11] 4,050,381

[45] Sept. 27, 1977

[54] LOW DENSITY INDIRECT FIRE MUNITION SYSTEM (U)

[75] Inventor: Robert W. Heinemann, Dover, N.J.

[73] Assignee: The United States of America as represented by the Secretary of the Army, Washington, D.C.

[21] Appl. No.: 246,090

[22] Filed: Apr. 12, 1972

[51] Int. Cl.[2] ..... F42B 25/02

[52] U.S. Cl. ..... 102/4; 102/24 HC; 102/70.2 P

[58] Field of Search ..... 102/3, 4, 24, 24 HC, 102/70.2 P; 89/1.5

[56] References Cited

U.S. PATENT DOCUMENTS

| | | | |
|---|---|---|---|
| 2,255,245 | 9/1941 | Ferrel | 102/70.2 P |
| 2,809,585 | 10/1957 | Moses | 102/24 HC X |
| 2,972,949 | 2/1961 | MacLeod | 102/24 HC |
| 3,000,307 | 9/1961 | Trotter, Jr. | 102/3 X |
| 3,128,701 | 4/1964 | Rinehart et al. | 102/24 HC X |
| 3,269,314 | 8/1966 | Varian | 102/70.2 P |
| 3,557,697 | 1/1971 | Joyner et al. | 102/4 |
| 3,584,581 | 6/1971 | Flatau et al. | 102/4 |
| 3,646,888 | 3/1972 | Posson et al. | 102/4 |

*Primary Examiner*—David H. Brown

*Attorney, Agent, or Firm*—Nathan Edelberg; A. Victor Erkkila; Harold H. Card, Jr.

[57] ABSTRACT

The invention relates to a munition system, which can be dropped from aircraft and is capable of scanning the ground for military targets; e.g., tanks and vehicles, and then directionally propelling a projectile at the target when it locates one. The munition system includes a housing, which contains an explosive warhead capable of directionally propelling a projectile, a directional sensing fuze in alignment with the path of the projectile, and a parachute to retard the descent and induce rotation of the housing at a predetermined rate, whereby the sensing fuze has sufficient time to scan the ground along a spiral path for military targets.

6 Claims, 3 Drawing Figures

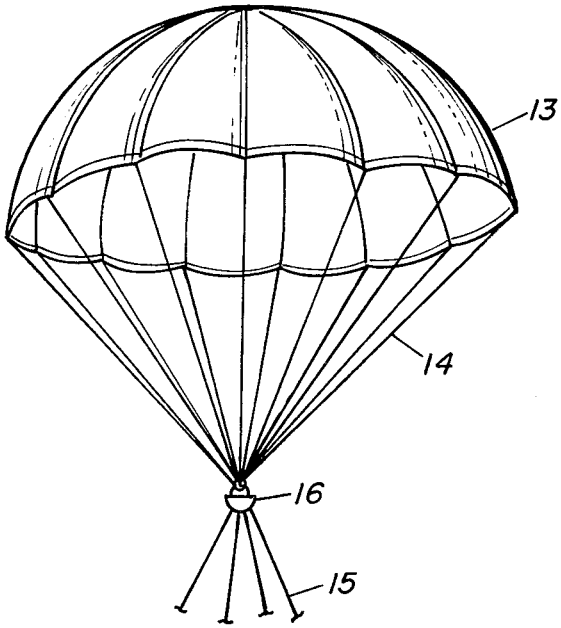
FIG. 1
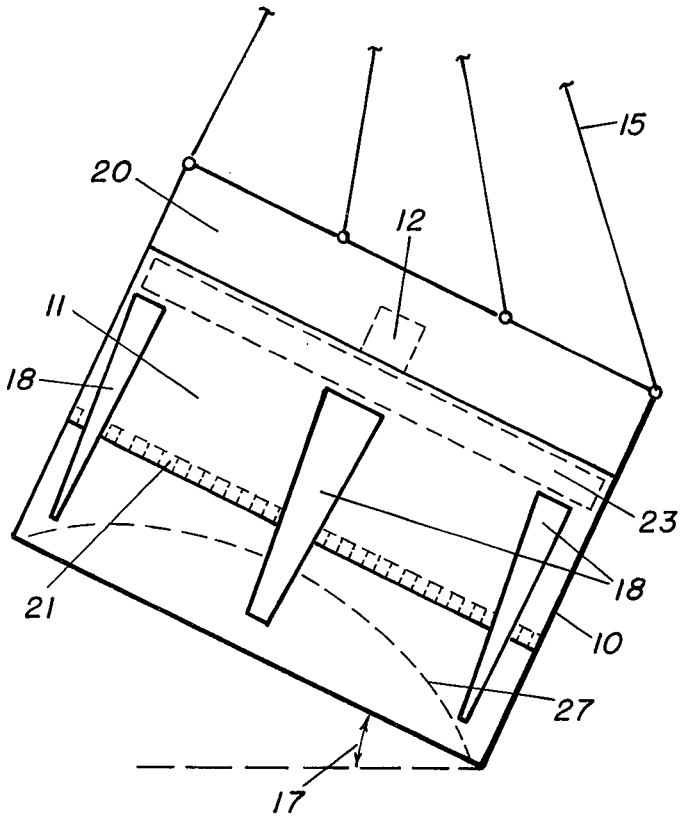

DOWNGRADED AT 12 YEAR INTERVALS;
NOT AUTOMATICALLY DECLASSIFIED.
DOD DIR 5200.10

LOW DENSITY INDIRECT FIRE MUNITION SYSTEM (U)

The invention described herein may be manufactured, used and licensed by or for the Government for governmental purposes without the payment to me of any royalty thereon.

BACKGROUND OF THE INVENTION

The invention relates to an indirect fire munition system, which can be deployed at low altitides and is capable of scanning the ground for military targets, such as tanks and vehicles, and then, when it has located a target, of firing a lethal mechanism, such as a projectile, at said target with a high strike probability.

The defeat of tanks and armored vehicles is a major military consideration. Direct fire defeat of such targets is costly, since it involves the risk of exposure to retaliatory fire by the enemy. Indirect fire (at targets beyond field of view) is expensive since large areas must be covered by such fire to obtain even a small fractional hit probability. Consequently, a need exists for a superior method and apparatus for defeating such targets, which is more effective, more economical and less risky than those previously utilized.

SUMMARY OF THE INVENTION

The present invention relates to a novel munition system, which combines (a) an explosive warhead capable of directionally projecting its lethal mechanism, with (b) a directional sensing fuze, which is aligned during manufacture with the path of the lethal mechanism. The fuze contains an electrical detonator coupled to a directional electronic sensing system containing a detector element, which is responsive to a characteristic signature of a military target, but is unresponsive to background and nonmilitary targets and which on detecting a military type target generates an output voltage which functions the electric detonator and explodes the warhead. The munition system also possesses a parachute adapted to retard the descent of the munition and means to induce rotation of the munition at a predetermined rate so that the sensing fuze has sufficient time to scan the ground completely along a spiral path for military targets.

An object of the invention is to provide a low density indirect fire munition system, which is capable of covering a large ground area with a high probability of target hit.

Another object is to provide a novel munition system, which can be deployed in the atmosphere for directionally and accurately firing a lethal mechanism at a military ground target without the use of guidance or homing devices.

A still further object is to provide an indirect fire munition system containing means which reduce the possibility of functioning of the warhead through the perception of false targets and of being countermeasured.

A further object is to provide a munition system which can be dropped from an airplane and during descent is capable of searching the ground below for military targets and then directionally firing a lethal mechanism at the target which it has located.

Other objects and many of the attendant advantages of the invention will be readily understood by reference to the following detailed description together with the accompanying drawings, wherein similar numerals refer to similar parts.

BRIEF DESCRIPTION OF THE DRAWINGS

FIG. 1 is a diagrammatic side view of an embodiment of the munition system of the present invention, as deployed.

DESCRIPTION OF THE PREFERRED EMBODIMENTS

Figure 2:
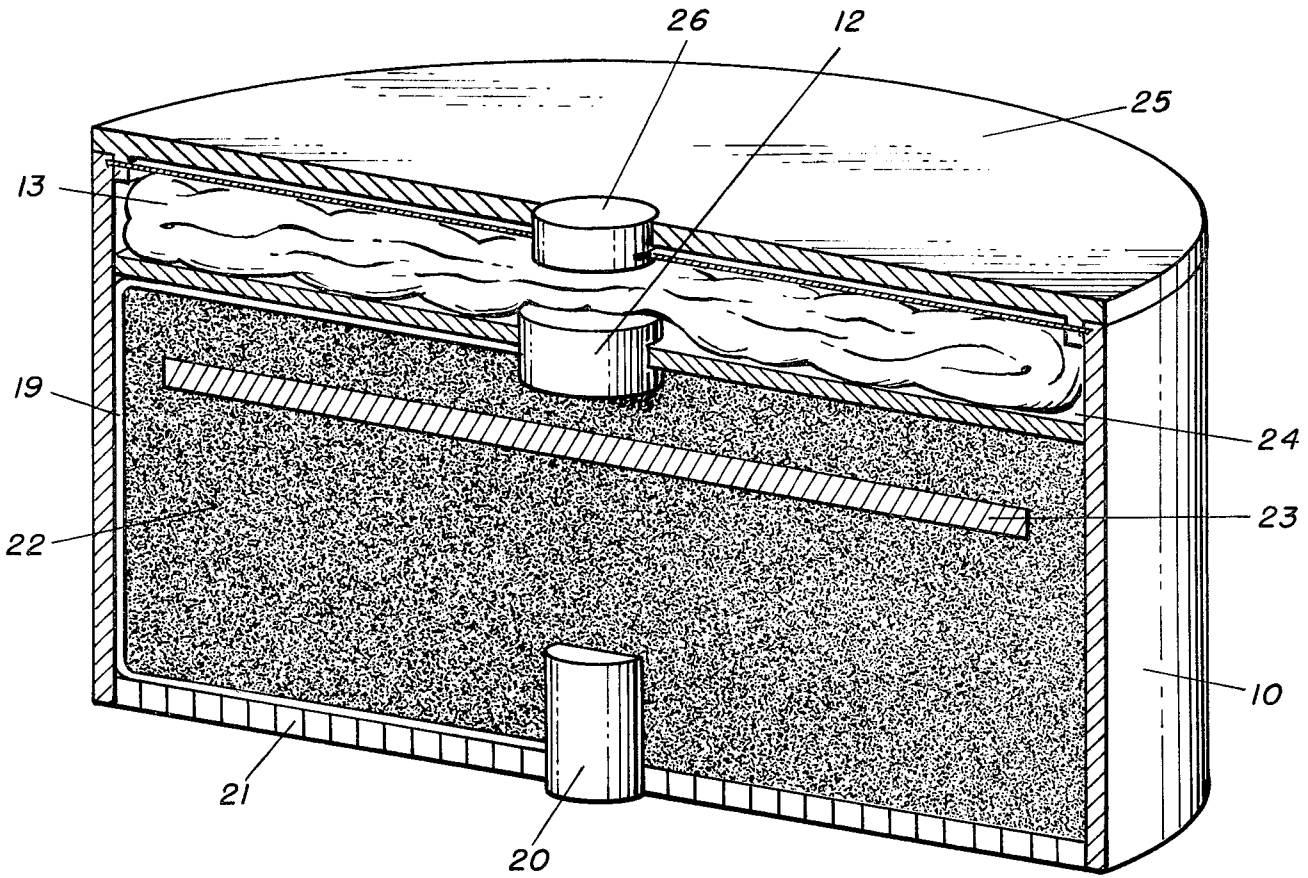
FIG. 2 is a diagrammatic cross-sectional view of a type of warhead of the invention prior to deployment.

The munition system shown in FIG. 1 comprises a cylindrical munition housing 10 of aluminum, iron or other suitable metal containing a directional firing warhead 11 coupled to an electrical fuze 12. The housing 10 is attached to a parachute 13 of the vortex ring type by means of lines 14 and 15 through a coupling 16, such as a ball and socket type coupling. Lines 15 are of different lengths so as to suspend the housing 10 at an angle 17 relative to the horizontal. Six fins 18 spaced 60° apart are affixed to the outside of the housing to assist in inducing a defined rate of rotation to the latter in known manner during its descent. As shown in FIG. 2, fuze 12 contains a conventional electric detonator (not shown) connected through lead 19 to an infrared sensor 20 comprising an optical and an electronic system. The infrared sensor can be adjusted to have a viewing (sensing) angle as small as one milliradian or less, so that at an altitude of 1,000 feet the sensor perceives a one foot circle on the ground an at that distance is capable of detecting radiation from a target if it is sufficiently warm. Infrared sensing systems of such capability are known in the art (e.g., used in Sidewinder and Redeye missiles) and utilize various detectors for this purpose; e.g., lead sulfide, lead selenide, and mercury cadmium telluride. The line of "viewing" or "sighting" of the IR sensor is adjusted so as to be in axial alignment with the path of the projectile to be fired from the warhead. The warhead 11 contains a pregrooved, fragmentable tungsten disc 21 which is laterally mounted toward the front in housing 10. Disc 21 is backed by a charge of high explosive 22, such as Composition B, Octol or plastic bonded explosive (PBX), which, in turn, is backed by a wave shaper 23. The latter is composed of a layer of lead, plastic or other suitable material, which directs the detonation wave from the explosive against the disc 21 so as to fragment and project the disc as pieces of tungsten at a spray angle designed to cover the "sighting" area of the IR sensor. Detonation wave-shaping techniques for adjusting the spray angle of fragments projected from pancake-shaped warheads such as the foregoing are well known in the art.

Prior to deployment of the munition system the parachute 13 is packed into a compartment 24 at the top of housing 10 formed by an extension of the upper end of the cylindrical housing, as shown in FIG. 2. The compartment 24 is closed with metal cover 25 which is provided with a suitable time latch 26.

In operation, the munition is dropped from an aircraft with the time latch 26 preset to open the cover 25 and deploy the parachute 13 at a suitable altitude; e.g., 500–1,000 feet, to retard the descent of the munition. As the parachute deploys, it pulls a connector line (not shown), which turns on a switch (not shown) for a battery (not shown) to activate the electronics system of the IR sensor ( In lieu of this the electronic sensing can be activated by means of an optical fuze using triangulation, or time response for distance measurement in an optical radar approach). As shown in FIG. 1, the housing 10 is induced to rotate during its descent, at a predetermined rate by aerodynamic forces acting on the parachute and the fins 18, causing the directional IR sensor to scan the ground along a spiral path. Further, the off-angle suspension of the housing from the parachute permits a greater area of coverage of the ground by the sensor as the housing rotates during its fall. The rates of fall and rotation of the housing are coordinated so that the spiral scanning path of each revolution of the sensor touches or overlaps the scanning path of the next revolution. For example, if the munition is deployed from a height of 500 feet at a fall rate of 50 feet/sec and spin rate of 5 rps., the sensor describes a spiral path whose center is initially about 10 feet distant from the center of the spiral path of the succeeding rovolution. Thus, by use of an IR sensor as shown in FIG. 2 with a 1° field of view angle, corresponding to an initial viewing circle about 10 feet in diameter, the ground area can be essentially completely covered. Therefore, if a target such as a military vehicle emitting heat (IR radiation), is present in the area, the IR sensor 20 detects that radiation and generates an output voltage, which is of sufficient intensity to explode the electrical detonator within the high explosive warhead fuze 12. The explosion of the detonator initiates the high explosive 22 in warhead 11, which in turn projects disc 21 in the form of 300 grain tungsten fragments at an initial velocity of about 9,000 feet per second at the target along a directional path in axial alignment with the line of "sight" of the IR sensor. The fragment spray angle is predetermined to be somewhat greater than the 1° viewing angle of the IR sensor. Since an overall time of sensor response and initiation of the explosive warhead of 500 microseconds or less can be attained in the known art, a direct hit of the target can be readily achieved in this manner.

In place of an IR sensor fuze noted above other fuzes containing directional electronic sensor systems can be employed. Electronic sensor systems suitable for use in the present invention must possess the following properties:

1. be directional in nature
2. have a narrow "viewing" angle (field of view)
3. have a response time ranging from microseconds to a few milliseconds
4. be capable of detecting an inherent signature of the target; e.g., heat, sound, or metal, and
5. provide an output voltage (generated on detection of target) capable of functioning an electric fuze to detonate the explosive warhead.

Such sensor systems generally comprise a detector, which utilizes an antenna, a microphone or an optical system, followed by a receiver containing the electronics system and logic, and a power source; e.g., a battery. For example, a microwave detector can use a parabolic directional antenna 27, as shown in FIG. 1. A microwave radiometer can be used to detect the location and passage of large metallic bodies, such as military tanks and vehicles. The more logical frequencies in which microwave radiometers are operated are 3 Ghz, 10 Ghz, 16 Ghz, 35 Ghz and 94 Ghz. Such units provide various viewing angles; i.e., 1½° at 94 Ghz and 4° at 35 Ghz (corresponding to a viewing circle of approximately 40 ft. diameter at 500 ft.), and have a range of more than 1,000 feet. Also, an acoustic detector system can be employed, wherein three or four microphones are used with a nulling technique to detect when the warhead (projectile path) is in line with the target.

In a preferred embodiment of the invention, a target sensing fuze having a combination of two or more detector (sensor) systems is employed, wherein each detector is dependent on a different target signature of a military target. Such combinations of different detector systems according to this invention reduce the possibility of functioning of the warhead through the perception of false targets and of being countermeasured. Thus, when a fuze with two different detector systems is used, each of the detector elements will cause a separate switch to be closed but both switches must be closed in order that a voltage is supplied to the electric detonator to fire the explosive warhead.

When a combination of different detector systems is utilized, at least one of the directional detectors must be able to accurately "pinpoint" the target, while another detector can provide general target location information. For example a fuze system can be employed, which combines an IR detector element having a very narrow "viewing" angle; e.g., 1° or less, with an acoustic detector having a wider "viewing" angle; e.g., 6-7°. If an audible signal is obtained in the approximate location where the IR detector pinpoints the location of the target, the fuze is functioned.

Another combination type fuzing system comprises the use of an IR detector coupled with an electromagnetic (EM) detector, which detects the radio waves being emitted by the engines of military vehicles, thereby detecting electromagnetic radiation as well as IR radiation. Both IR and EM radiation are required to explode the electrical detonator in the fuze.

A further combination fuze utilizes a microwave radiometer, which detects the location of large metallic bodies and provides pinpointing directional capability (very narrow viewing angle) , coupled with either an acoustic or electromagnetic detector possessing a relatively wide viewing angle, the latter signature being used for confirmation.

A still further fuze uses a magnetometer coupled with either a microwave radiometer or an IR detector.

It is thus evident that the present invention provides a variety of novel combination fuze detectors for use in the novel munition system, wherein each of the detectors is sensitive to a different target signature ( type or radiation emitted by a target). Detector elements of the aforementioned type, including associated electronic systems, are known in the art; but their use in combination in the manner described above is novel and increases the efficiency and effectiveness of the munition system of the present invention.

Figure 3:
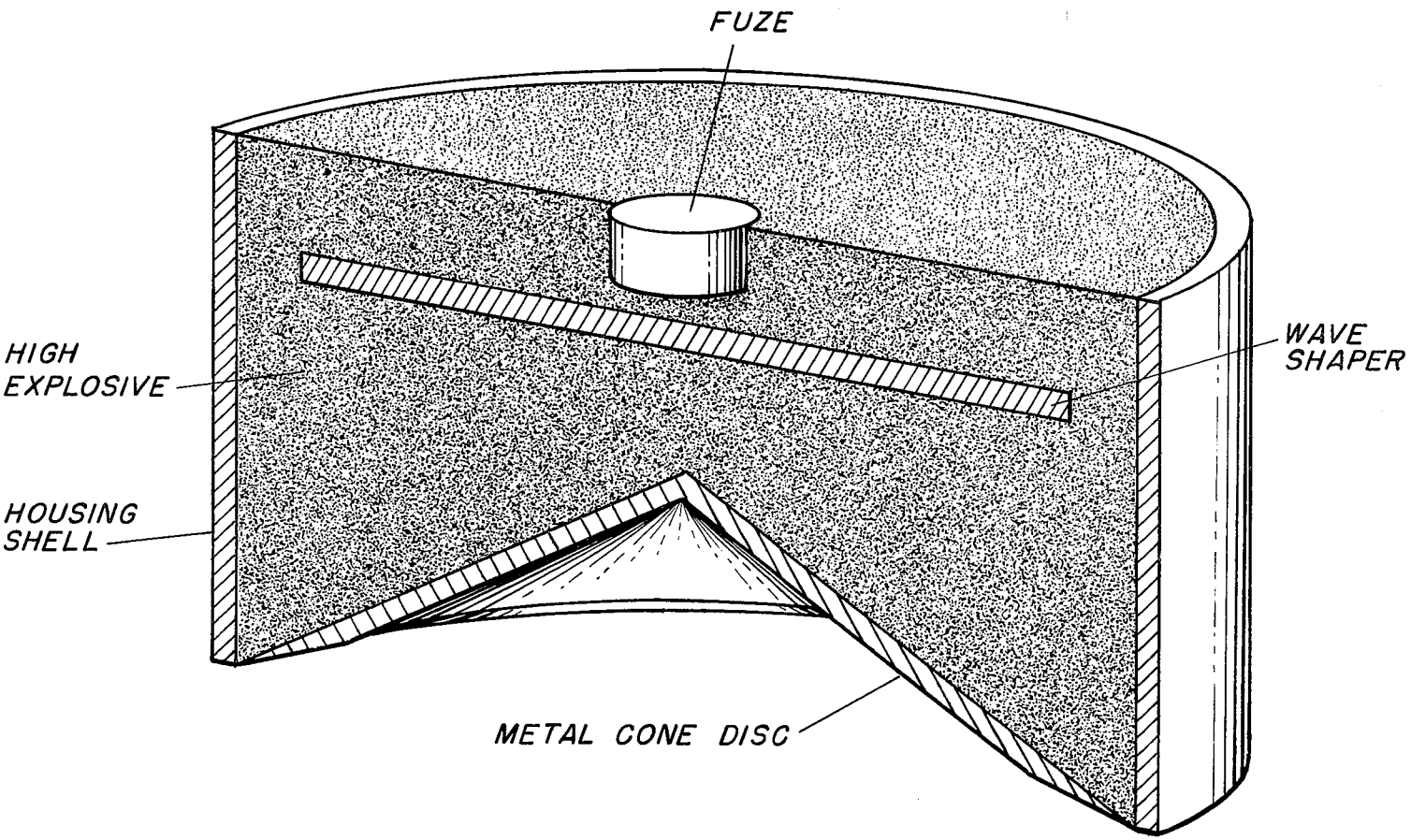
FIG. 3 is a diagrammatic view in cross-section of another type of warhead suitable for use in the novel munition system.

Further, the invention is not limited to a pancake shaped warhead, which projects a lethal fragment spray directionally aligned with the line of view of the sensor, as illustrated above. In such a pancake shaped explosive warhead, the spray angle of the projected metal fragments can be predetermined according to well-known detonation wave shaping techniques and is designed to cover the viewing area (field of view) of the sensor. For example, if an IR sensor with viewing angle of 2° is employed, the fragment spray angle would be adjusted to slightly more than 2° to cover the target. Other warheads can be employed, for example, as shown in FIG. 3, wherein the metal to be projected is positioned as a cone or hemispherically shaped disc; e.g., of iron or copper, backed by a layer of high explosive with a wave-shaper and a fuze at the rear end of the explosive layer. Such a warhead fires a rod-shaped armor-piercing projectile, which is formed dynamically during the explosion process, as in Miznay Schardin projectiles. By employing a very narrow beam (pinpoint) sensor; e.g., a ½ milliradian IR sensor, it is possible to utilize such a dynamically formed rod projectile, which is capable of similar pinpoint accuracy when aligned with the sensor.

Although the munition system is deployed from an aircraft in the foregoing detailed description, it is obvious that the novel munition system can be delivered by other suitable means; e.g., in a projectile fired from a mortar or cannon, which ejects and deploys the munition system over the desired target area.

I wish it to be understood that I do not desire to be limited to the exact detail of construction shown and described for obvious modification will occur to a person skilled in the art.

I claim:

1. An indirect fire munition system for deployment from the atmosphere for defeating armor and vehicular military type ground targets without the use of guidance or homing devices, which comprises in combination:

a directional firing explosive warhead, a directional target sensing fuze coupled with said warhead;

a housing for said warhead and fuze;

a parachute attached to said housing for retarding the descent of the munition on deployment; and vane means for inducing rotation of said housing during descent; wherein said fuze comprises an electric detonator coupled to a directional electronic sensing system containing a detector element, which is responsive to a characteristic signature of such a military target but is unresponsive to background and nonmilitary type targets, and which on detecting a military type target generates an output voltage which functions the electric detonator and explodes the warhead;

said warhead comprises a projectile and an explosive propellant for directionally propelling said projectile at the target in alignment with the viewing axis of said directional sensing system; and said vane means is adapted to induce rotation of said housing by aerodynamic forces at a predetermined rate during descent and thereby cause the directional sensing element to scan the ground along a spiral path.

2. The munition system according to claim 1, wherein the warhead contains a flat metal disc backed by a layer of high explosive followed by a detonation wave shaper and is capable of projecting a spray of metal fragments of predetermined spray angle sufficient to cover the viewing area of the sensing system.

3. The munition system according to claim 1, wherein the warhead contains a Misznay-Schardin Charge metal disc comprising a cone or shaped liner backed by a layer of high explosive and a detonation wave shaper and projects a rod-shaped armor piercing projectile dynamically formed during the explosion.

4. The munition system according to claim 1, wherein said fuze comprises at least two directional electronic sensing systems each responsive to a different, characteristic signature of a military target, wherein at least one sensing system possesses a narrow viewing angle for accurately locating the target, and wherein the output voltage generated by both the narrow viewing sensing system and at least one other sensing system is required to function the electric detonator.

5. The munition system according to claim 4, wherein said fuze comprises two directional electronic sensing systems each responsive to a different, characteristic signature of a military target, wherein one sensing system possesses a narrow viewing angle for accurately locating the target and the other sensing system possesses a wider viewing angle.

6. The munition system according to claim 5, wherein the sensing system with the narrow viewing angle utilizes an infrared detector and the sensing system with a relatively wide viewing angle utilizes a detector selected from the group consisting of acoustic, electromagnetic and microwave detectors.

* * * * *